United States Patent [19]

Sugiura

[11] Patent Number: 4,991,549

[45] Date of Patent: Feb. 12, 1991

[54] CAMSHAFT LUBRICATING SYSTEM FOR ENGINE

[75] Inventor: Yoshiaki Sugiura, Iwata, Japan

[73] Assignee: Yamaha Hatsudoki Kabushiki Kaisha, Iwata, Japan

[21] Appl. No.: 447,632

[22] Filed: Dec. 8, 1989

[51] Int. Cl.[5] ..... F01L 9/02

[52] U.S. Cl. ..... 123/90.27; 123/90.34; 123/196 M; 184/6.5

[58] Field of Search ..... 123/90.27, 90.33, 90.34, 123/90.37, 90.38, 196 M; 184/6.5

[56] References Cited

U.S. PATENT DOCUMENTS

| | | | |
|---|---|---|---|
| 4,343,270 | 8/1982 | Kawabe | 123/90.34 |
| 4,565,168 | 1/1986 | Rivere | 123/90.34 |
| 4,632,073 | 12/1986 | Futakuchi | 123/90.27 |
| 4,660,529 | 4/1987 | Yoshikawa | 123/90.27 |
| 4,681,069 | 7/1987 | Honma | 123/90.27 |
| 4,771,745 | 9/1988 | Nakamura et al. | 123/196 M |
| 4,777,842 | 10/1988 | Yamada | 123/90.34 |

FOREIGN PATENT DOCUMENTS 23951 of 1913 United Kingdom ..... 123/90.34

*Primary Examiner*—Charles J. Myhre
*Assistant Examiner*—Weilun Lo
*Attorney, Agent, or Firm*—Ernest A. Beutler

[57] ABSTRACT

A lubricating arrangement for the overhead camshafts of an internal combustion engine. The cylinder head assembly is formed with wells in which lubricant can accumulate during the running of the engine and which surround at least in part the camshafts. When the engine stops running, the wells will retain lubricant so that the camshaft will be lubricated immediately upon start up. The wells associated with at least one of the camshafts are formed at least in part by the bearing caps that journal the camshafts. One camshaft is supported by a greater number of bearings than the other camshaft and the fastening means associated with the camshaft bearings of the camshaft having the greater number of bearings are smaller than those associated with the other camshaft so as to insure equal torque down.

11 Claims, 2 Drawing Sheets

CAMSHAFT LUBRICATING SYSTEM FOR ENGINE

BACKGROUND OF THE INVENTION

This invention relates to a camshaft lubricating system for an engine and more particularly to an improved arrangement for insuring that the camshafts and valve train of an internal combustion engine will be lubricated immediately upon starting of the engine.

The criticality of providing adequate lubrication to the moving components of an internal combustion engine are well known. Even though the desirability of maintaining adequate lubrication for the engine is well known, there are certain conditions of engine operation wherein it is difficult if not impossible with present constructions so as to insure adequate lubrication of the components. For example, when the engine is running, it is a relatively simple matter to supply lubricant under pressure to those components which should be lubricated. However, when the engine has been shut down and then is restarted, there is normally some delay before the lubricant is delivered to all of the moving components. The more remote the component is from the lubricant reservoir and the lubricant pump, the more likely this component will not be adequately lubricated upon initial start up. It is well known that a large proportion of the wear of the components of the internal combustion engine occurs during start up.

One area wherein this lubricating problem is particularly acute is the lubrication system for the valve train, particularly with overhead valve overhead camshaft type engines. Normally the lubricant is supplied to the bearings and cam lobes and tappets through a pressure system that delivers the oil to the cam bearings or camshaft frequently through hollow internal passages in the camshaft. Because of the remote location, these components can be subject to high wear on initial start up when the oil has all drained from the cylinder head during long periods of inactivity.

It is, therefore, a principal object of this invention to provide an improved arrangement for lubricating the camshafts and valve train of an internal combustion engine.

It is a further object of this invention to provide a system wherein it is insured that the valve train or at least major components of it will be immersed in lubricant even when the engine is not running so as to insure adequate lubricant delivery upon start up.

It is a further object of this invention to provide an arrangement for trapping oil around certain of the valve train components that may accumulate when the engine is running and then will be available to lubricate these components when the engine is restarted after shutdown.

SUMMARY OF THE INVENTION

This invention is adapted to be embodied in a cylinder head arrangement for an internal combustion engine having first and second camshafts journaled for rotation relative to the cylinder head for operating poppet valves reciprocating in the cylinder head. Means are provided for delivering lubricant to the cylinder head for lubricating the camshafts. In accordance with the invention, means are provided for forming a lubricant dam to trap and retain a volume of lubricant in contact with the camshaft and at least partially submerging the camshaft when the means for delivering lubricant ceases to deliver lubricant due to stopping of the engine.

DETAILED DESCRIPTION OF THE PREFERRED EMBODIMENT OF THE INVENTION

Figure 1:
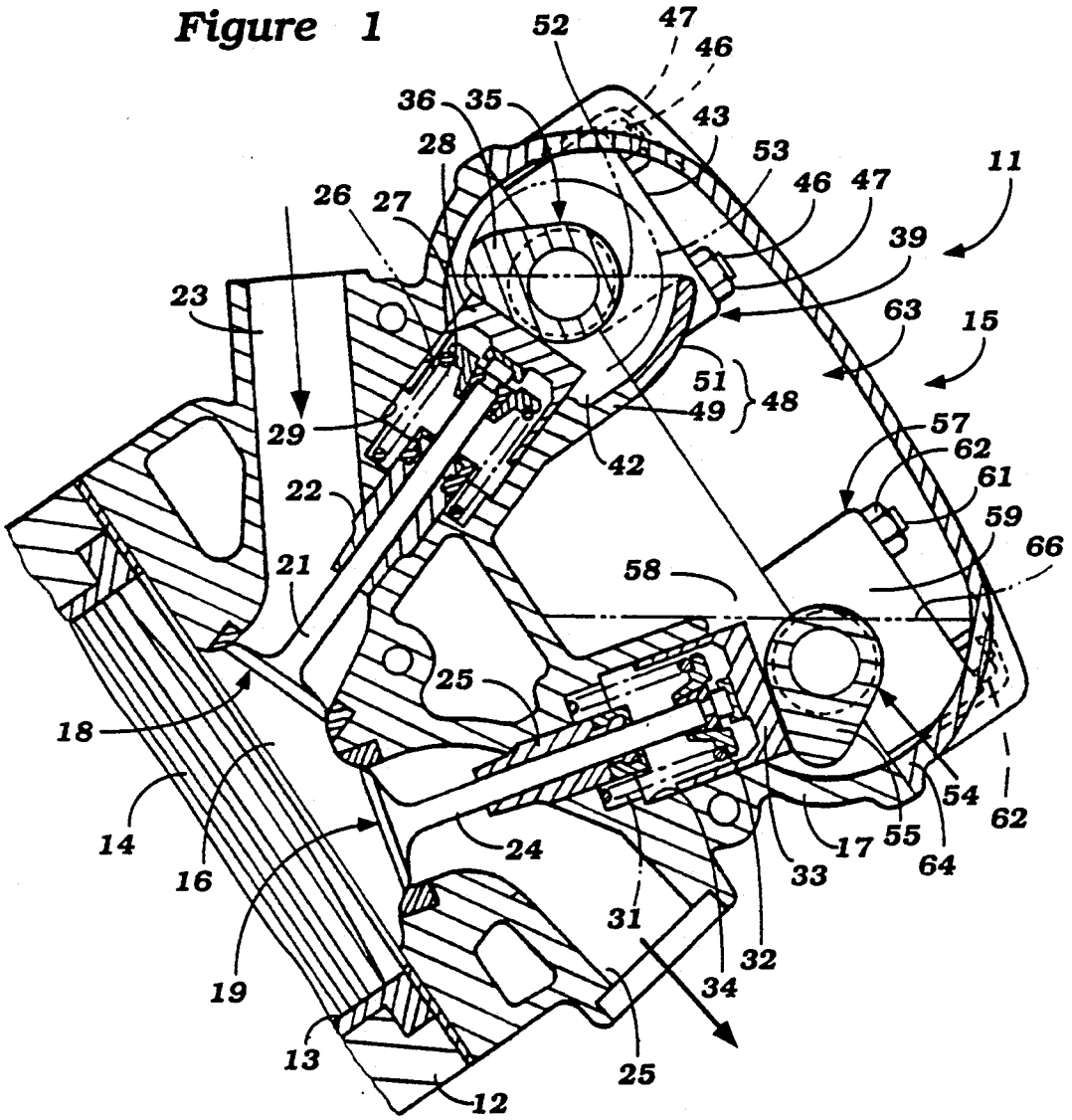
FIG. 1 is a cross-sectional view taken through the cylinder head of an internal combustion engine constructed in accordance with an embodiment of the invention and is taken generally along the line 1—1 of FIG. 2.
Figure 2:
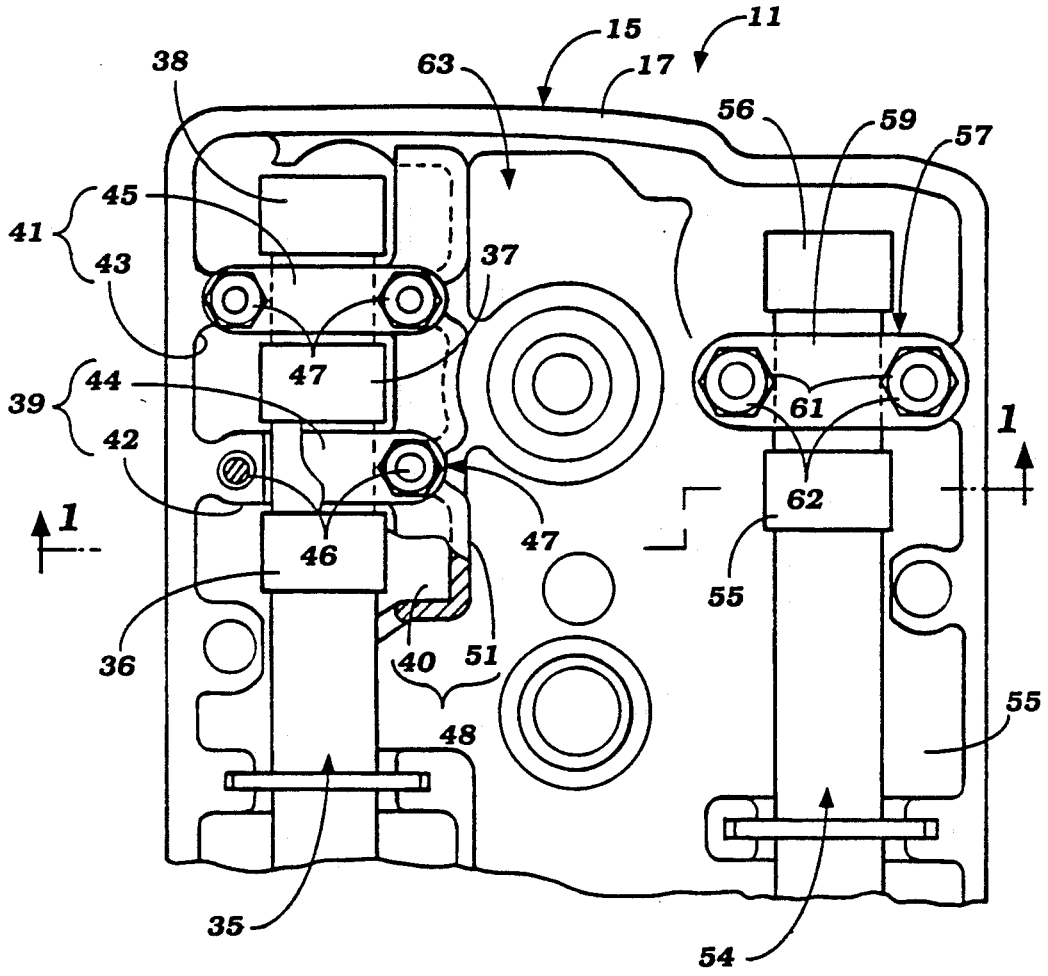
FIG. 2 is a top view of a portion of the cylinder head with the cam cover removed and a portion broken away to more clearly show the construction.

Referring now in detail to the drawings, an internal combustion engine constructed in accordance with an embodiment of the invention is shown partially and is identified generally by the reference numeral 11. Since the invention deals primarily with the valve train and lubricating system for it, only this portion of the engine has been illustrated. The remaining components of the engine may be considered to be conventional or those which are well known to those skilled in the art.

The engine 11 includes a cylinder block 12 that has one or more cylinder bore 13. In the illustrated embodiment, the cylinder block 12 is disposed so that the cylinder bores 13 are inclined to the vertical as in conjunction with a slanted engine or one cylinder bank of a V type engine. Although the invention has particular utility in conjunction with engines wherein the cylinder bores are so oriented, the invention may also be employed in conjunction with engines having vertically aligned cylinder bores, as will become apparent to those skilled in the art. In the illustrated embodiment the engine 11 is slanted toward the front of an associated vehicle as indicated by the arrow Fr.

Pistons 14 are slidably supported within the cylinder bores 13 and are connected by means of connecting rods (not shown) to a camshaft in a well known manner.

A cylinder head assembly, indicated generally by the reference numeral 15 is affixed to the cylinder block 12 in any known manner and is formed with individual recesses 16 that cooperate with each of the cylinder bores 13 and pistons 14 to form a combustion chamber of any desired configuration.

The cylinder head assembly 15 includes a main cylinder head casting 17 in which the recesses 16 are formed and which slidably support a plurality of intake valves 18. In the illustrated embodiment, there are provided three intake valves per cylinder bore 13. In addition, on generally the opposite side of the cylinder head 17 there are slidably supported two exhaust valves 19. The intake valve 18 and exhaust valves 19 may be disposed in an orientation as shown and described in Letters U.S. Pat. No. 4,660,529, entitled "Four Cycle Engine", issued Apr. 28, 1987 in the name of Masaaki Yoshikawa and assigned to the Assignee of this application. It is to be understood, however, that the invention may be employed with engines having other numbers of intake and exhaust valves per cylinder.

The intake valves 18 have valve stems 21 that are slidably supported in guides 22 that are pressed into the cylinder head casting 17 and which control the flow of an intake charge from a suitable charge former (not shown) through one or more intake passageways 23 into the combustion chamber formed by the recess 16.

In a like manner, the exhaust valves 19 have stem portions 24 that are slidably supported within guides 25 and which control the discharge of exhaust gases from the combustion chamber 16 to the atmosphere through exhaust ports 25 and an appropriate exhaust system (not shown).

The intake valves 18 are each surrounded by coil compression springs 26 that act against the cylinder head casting 17 and a keeper retainer assembly 27 for urging the intake valves 18 to their closed position. The intake valves 18 are opened by means of an actuating mechanism, to be described, which includes thimble tappets 28 that are slidably supported within bores 29 formed in the cylinder head casting 17 and which cooperate with the tips of the valve stems 21 in a known manner.

In a similar manner, the exhaust valves 19 are urged to their closed position by means of coil compression springs 31 that encircle their stems 24 and which act against keeper retainer assemblies 32 and the cylinder head casting 17 for urging the exhaust valves 19 to their closed positions. Thimble tappets 33 are slidably supported in bores 34 formed in the cylinder head casting 17 for opening the exhaust valves 19 in a manner which will be described.

An intake camshaft 35 is supported within the cylinder head assembly 15 and has individual cam lobes 36, 37 and 38 which cooperate with the respective thimble tappets 28 associated with each of the intake valves 21 of the respective cylinder bore 13. Bearing surfaces are formed on the intake camshaft 35 between the cam lobes 36, 37 and 38 and bearing assemblies 39 and 41 cooperate with these bearing surfaces so as to rotatably journal the intake camshaft 35 in the cylinder head assembly 15.

The bearing assemblies 39 and 41 are formed respectively by bearing surfaces 42 and 43 formed integrally with the cylinder head casting 17 and with bearing caps 44 and 45 that are affixed to the cylinder head casting 17 by means of studs 46 and nuts 47.

In accordance with conventional practice, oil passages may be formed in the cylinder head for delivering oil to the interior of the camshaft 35 where it is delivered to the bearing assemblies 39 and 41 through cross drilled holes for lubrication of these bearing assemblies. In addition, the lubricant will flow to lubricate the cam lobes 36, 37 and 38 in a manner to be described.

It should be noted that the cylinder head casting 17 is provided with a construction for forming an oil well 48 and associated with the cam lobes 36, 37 and 38 of each cylinder. These wells 48 are formed by means of upstanding walls 49 formed integrally with the cylinder head casting 17 and which cooperate with a wall 51 formed by the bearing caps 44 and 45 so that the bearing caps 44 and 45 and wall 51 form a unitary assembly. Lubricant will fill within the wells 48 to a level indicated by the line 52 when the engine is running so as to trap lubricant in the area of the cam lobes 36, 37 and 38 and tappets 28 for their lubrication. This oil is delivered from leakage from the bearing assemblies 39 and 41 and will accumulate during engine running, as aforenoted. Additional oil supplied during running will drain over the top of the walls 51 and can be returned back to the lubricant sump through the normal return drains in the cylinder head 17 (not shown).

It will be seen that the cam lobes 36, 37 and 38 rotate through an arc indicated by the line 53 in FIG. 1 which will successively immerse and remove the cam lobes 36, 37 and 38 from this lubricant. In addition to providing lubrication when the engine is running, when the engine is shut down, the wells 48 will trap lubricant. This trapped lubricant will insure lubrication of not only the cam lobes 36, 37 and 38 and tappets 28 on start up, but also the bearing surfaces of the camshaft since it should be readily apparent that they also are immersed.

An exhaust camshaft, indicated generally by the reference numeral 54 is journaled within the cylinder head assembly 15 in a manner to be described and has pairs of cam lobes 55 and 56 that cooperate with the thimble tappets 33 associated with the exhaust valves 19 for opening these exhaust valves. The exhaust camshaft 54 is journaled by individual bearing assemblies, indicated generally by the reference numeral 57 which cooperate with bearing surfaces formed between the individual cam lobes 55 and 56. These bearing assemblies include a bearing surface 58 formed integrally by the cylinder head casting 17 and a bearing cap 59 that is affixed to the cylinder head casting 17 by means of studs 61 and nuts 62. Since there is only one bearing assembly 57 associated with each cylinder of the exhaust camshaft 54 while there are two bearing assemblies 39 and 41 with the intake camshaft 35 associated with each cylinder, the studs 61 and nuts 62 are made of a larger diameter than the studs 46 and nuts 47 associated with the intake camshaft 35 so as to insure good hold down relationship.

The valve assembly now described is contained within a cam tower recess 63 formed by the cylinder head assembly and which is closed by means of a cam cover 64 that is affixed to the cylinder head casting 17 in a known manner. The inclined configuration of the cylinder head assembly 15 also forms a well 65 that is in proximity to the bearings 59 and cam lobes 55 and 56 and in which lubricant which is delivered to the camshaft bearing surfaces through the bearing assembly 59 can accumulate to a level shown by the line 66 in FIG. 1. Therefore, like the wells associated with the intake camshaft tappets and bearing surfaces, lubricant will accumulate during running and also will be maintained in this area when the engine is shut down so as to insure immediate lubrication when the engine is restarted.

It is to be understood that the foregoing description is that of a preferred embodiment of the invention and that various changes and modifications may be made without departing from the spirit and scope of the invention, as defined by the appended claims.

I claim:

1. A cylinder head arrangement for an internal combustion engine wherein the cylinder head is disposed at an inclined angle and having first and second camshafts journaled for rotation relative to said cylinder head for operating poppet valves reciprocating in said cylinder head, means for delivering lubricant to said cylinder head for lubricating said camshafts, and means for forming a lubricant dam to trap and retain a volume of lubricant in contact with said camshafts and at least partially submerging said camshafts when said means for delivering lubricant ceases to deliver lubricant.

2. A cylinder head arrangement as set forth in claim 1 wherein a separate dam is formed for each of the camshafts.

3. A cylinder head arrangement as set forth in claim 2 wherein the dams are formed at least in part by integral walls of the cylinder head.

4. A cylinder head arrangement as set forth in claim 3 wherein the well associated with one of the camshafts is formed in part by a peripheral surface of the cylinder head assembly and the well associated with the other of the camshafts is formed at least in part by a central upstanding wall of the cylinder head assembly.

5. A cylinder head arrangement as set forth in claim 4 wherein the camshafts are journaled by bearing caps and the bearing caps associated with the other of the camshafts have areas further defining the wells.

6. A cylinder head arrangement as set forth in claim 1 wherein the camshafts are journaled on the cylinder head assembly by bearing caps.

7. A cylinder head arrangement for an internal combustion engine having first and second camshafts journaled for rotation relative to said cylinder head by respective bearing caps for operating poppet valves reciprocating in said cylinder head, means for delivering lubricant to said cylinder head for lubricating said camshafts, and means for forming a lubricant dam to trap and retain a volume of lubricant in contact with said camshafts and at least partially submerging said camshafts when said means for delivering lubricant ceases to deliver lubricant, the number of bearing caps associated with one of said camshafts being greater than the number associated with the other of said camshafts and threaded fastening means for affixing said bearing caps to the cylinder heads and wherein the threaded fastening means associated with the camshaft having the greater number of bearings caps have a smaller diameter.

8. A cylinder head arrangement for an internal combustion engine having a first camshaft journaled by means including bearing caps for rotation relative to said cylinder head for operating poppet valves reciprocating in said cylinder head, means for delivering lubricant to said cylinder head for lubricating said camshaft, and means for forming a lubricant dam to trap and retain a volume of lubricant in contact with said camshaft and at least partially submerging said camshaft when said means for delivering lubricant ceases to deliver lubricant, said dam being formed at least in part by said bearing caps.

9. A cylinder head arrangement as set forth in claim 8 wherein the cylinder head is disposed in an inclined relationship.

10. A cylinder head arrangement as set forth in claim 8 wherein the well associated is formed at least in further part by an upstanding wall of the cylinder head assembly.

11. A cylinder head arrangement for an internal combustion engine having first and second camshafts journaled for rotation relative to said cylinder head for operating poppet valves reciprocating in said cylinder head, means for journaling said first and said second camshafts comprising respective first and second sets of bearing caps each associated with the respective of said first and said second camshafts, a first series of threaded fastening means for affixing said first series of bearing caps to said cylinder head, and a second series of threaded fastenings means for affixing said second series of bearing caps to said cylinder head, the number of bearing caps in said first series being greater than the number of bearings caps in said second series, the threaded fastening means of said first series having a smaller effective diameter than the threaded fastening means of said second series.

* * * * *